US006080012A

United States Patent [19]

Zhu et al.

[11] Patent Number: 6,080,012

[45] Date of Patent: Jun. 27, 2000

[54] ELECTRICAL CONNECTOR HAVING A RETENTION MECHANISM

[75] Inventors: Zi-Qiang Zhu; Xiao-Cheng Zhu, both of Kun-San, China; Shu-Ying Sheu, Hsin-Chu, Taiwan

[73] Assignee: Hon Hai Precision Ind. Co., Ltd., Taipei Hsien, Taiwan

[21] Appl. No.: 09/372,659

[22] Filed: Aug. 11, 1999

[30] Foreign Application Priority Data

Nov. 3, 1998 [TW] Taiwan ..... 87218241

[51] Int. Cl.[7] ..... H01R 13/73

[52] U.S. Cl. ..... 439/567; 439/571

[58] Field of Search ..... 439/567, 571, 439/572

[56] References Cited

U.S. PATENT DOCUMENTS 5,415,565 5/1995 Mosquera ..... 439/571

5,772,453 6/1998 Tan et al. ..... 439/567

*Primary Examiner*—Gary F. Paumen

*Attorney, Agent, or Firm*—Wei Te Chung

[57] ABSTRACT

An electrical connector having a retention mechanism for steadily securing the electrical connector to a mating circuit board comprises a dielectric housing, a number of contacts received in the housing and shield for enclosing the housing. The retention mechanism comprises a pair of lugs integrally and downwardly extending from the shield. Each lug includes an engaging means forming a pair of barbs thereon and a cutout defined between the pair of barbs for engaging within a corresponding positioning hole defined in the mating circuit board. Each lug has a length substantially equal to a thickness of the mating circuit board so that the retention mechanism will not scrape away solder coated on an inner surface of each positioning hole of the circuit board. Thus, excellent soldering connections between the electrical connector and the mating circuit board are established.

1 Claim, 5 Drawing Sheets

ELECTRICAL CONNECTOR HAVING A RETENTION MECHANISM

BACKGROUND OF THE INVENTION

The present invention relates to a retention mechanism of an electrical connector, and particularly to a retention mechanism for steadily securing an electrical connector to a circuit board without scraping solder applied on the circuit board.

A conventional retention mechanism of an electrical connector commonly comprises a plurality of boardlocks integrally extending from the connector for being soldered to a mating circuit board. Common techniques adopted to solder conventional boardlocks of an electrical connector to a mating circuit board include both wave soldering technology and surface mount technology (SMT). SMT can quicken the manufacturing process, increase production, provide stable signal transmission quality and lower costs. When SMT is applied, solder is applied to a surface of a circuit board and electrical elements are then deposited on the circuit board.

Conventional boardlocks of an electrical connector are commonly inserted into corresponding through holes of a mating circuit board. Usually, solder is applied to inner surfaces of the through hole. Therefore, latching or projection means formed on the boardlocks will scrape the solder off the inner surfaces of the through holes thereby weakening the quality of the solder connection.

A pertinent prior art is disclosed in U.S. Pat. No. 4,907,987. Referring to FIGS. 6A and 6B, a conventional boardlock 42' of an electrical connector forms a pair of legs 46' forming arcuate projections 48' on opposite lateral edges thereof corresponding to a positioning hole 51' of a mating circuit board 5'. An inner surface of the positioning hole 51' is coated with solder 55'. However, when the boardlock 42' is inserted into the positioning hole 51', the arcuate projections 48' scrape the solder 55' off the inner surface of the positioning hole 51'. Thus, the electrical connector can not be securely soldered to the mating circuit board 5' and additional manual welding procedures are required to achieve satisfactory soldering quality thereby increasing costs.

BRIEF SUMMARY OF THE INVENTION

A main object of the present invention is to provide a retention mechanism for reliably securing an electrical connector without wasting or scraping away solder from positioning holes of a mating circuit board.

A retention mechanism of an electrical connector in accordance with the present invention comprises at least a pair of lugs. Each lug has an engaging means for latching within a corresponding positioning hole of a mating circuit board thereby reliably securing the electrical connector thereon. The engaging means is inserted into the positioning hole, but does not extend out of the positioning hole, thus preventing solder coated on an inner surface of the positioning hole from being scraped off.

Other objects, advantages and novel features of the invention will become more apparent from the following detailed description when taken in conjunction with the accompanying drawings.

DETAILED DESCRIPTION OF THE INVENTION

Figure 2:
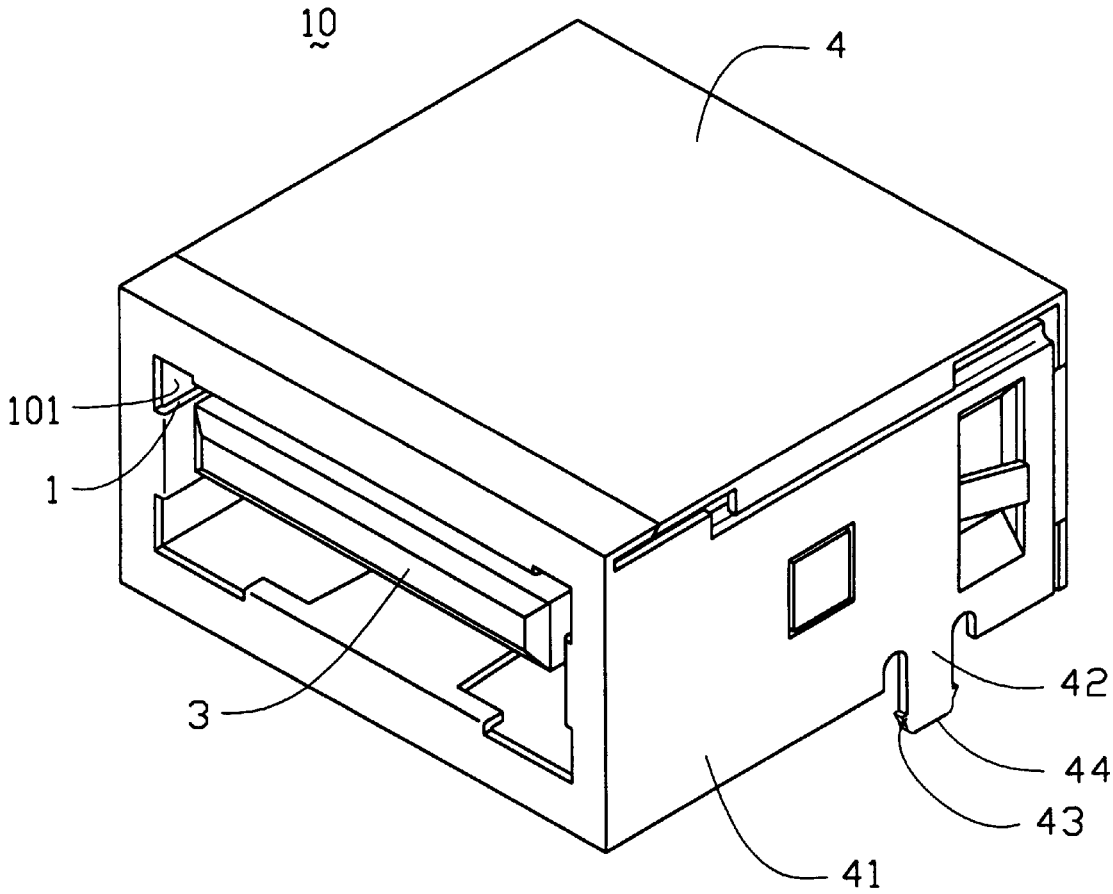
FIG. 2 is a perspective view of an electrical connector including the retention mechanism of the present invention.
Figure 3A:
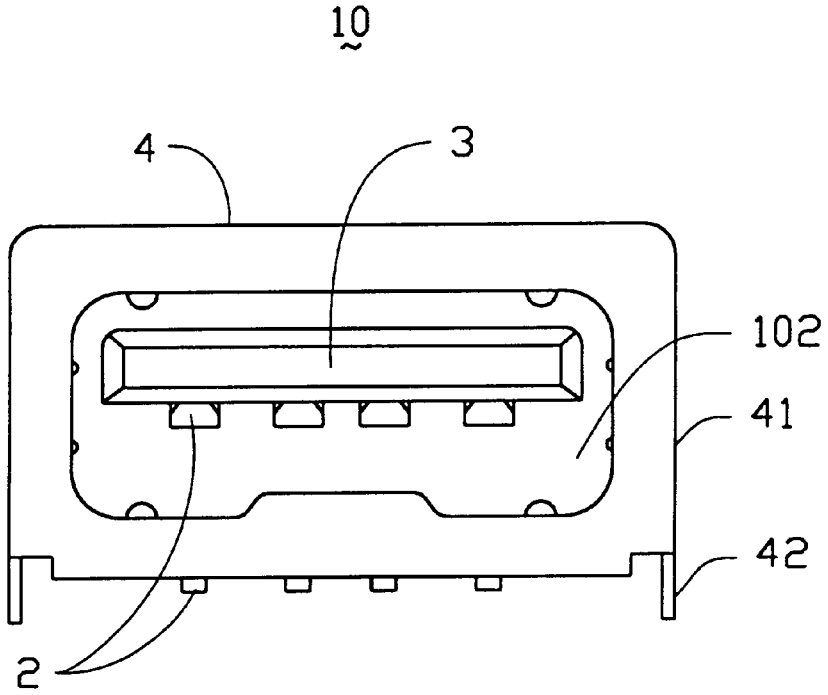
FIG. 3A is a front elevational view of FIG. 2.
Figure 3B:
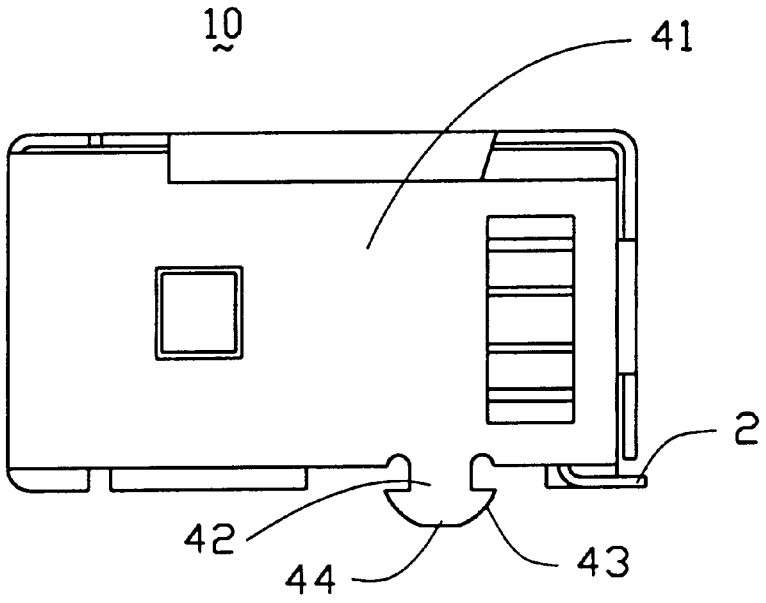
FIG. 3B is a side elevational view of the electrical connector having the retention mechanism.

Referring to FIGS. 2, 3A and 3B, a retention mechanism in accordance with the present invention can be adapted for use with any type of electrical connector which utilizes boardlocks to connect to a mating circuit board. The retention mechanism in accordance with a first embodiment of the present invention extends from a Universal Serial Bus (USB) electrical connector. The electrical connector 10 comprises a dielectric housing 1 including a contact receiving board 3, a plurality of contacts 2 received in the contact receiving board 3, and a shield 4. The housing 1 forms a mating surface 101 and defines a cavity 102 exposed to the mating surface 101. The contact receiving board 3 is received in the cavity 102.

Each contact 2 comprises a mating portion received in the contact receiving board 3 and a soldering portion perpendicular to the mating portion and forming a horizontal free end for being surface mounted to a mating circuit board.

The shield 4 encloses the housing 1 for protecting the electrical connector from electromagnetic interference. The retention mechanism comprises a pair of lugs 42 downwardly extending from opposite sides 41 of the shield 4. Each lug 42 forms an engaging means 43 including a pair of barbs on opposite lateral edges thereof.

Figure 1:
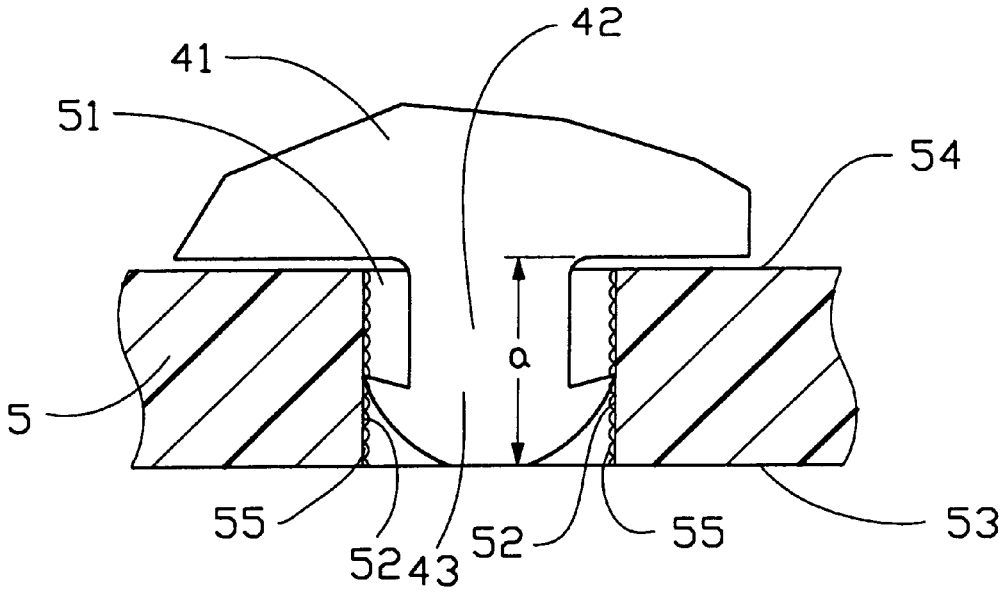
FIG. 1 is a cross sectional view of a retention mechanism in accordance with a first embodiment of the present invention received in a through hole of a circuit board.

Also referring to FIG. 1, the engaging means 43 of each lug 42 interferentially engages with an inner surface 52 of a positioning hole 51 of a mating circuit board 5. The length "a" of each lug 42 is not larger than a thickness of the circuit board 5. Therefore, the retention mechanism does not extend beyond a bottom surface 53 of the circuit board 5. Thus, solder 55 coated on the inner surface 52 of the corresponding positioning hole 51 will not be scraped off.

Figure 4:
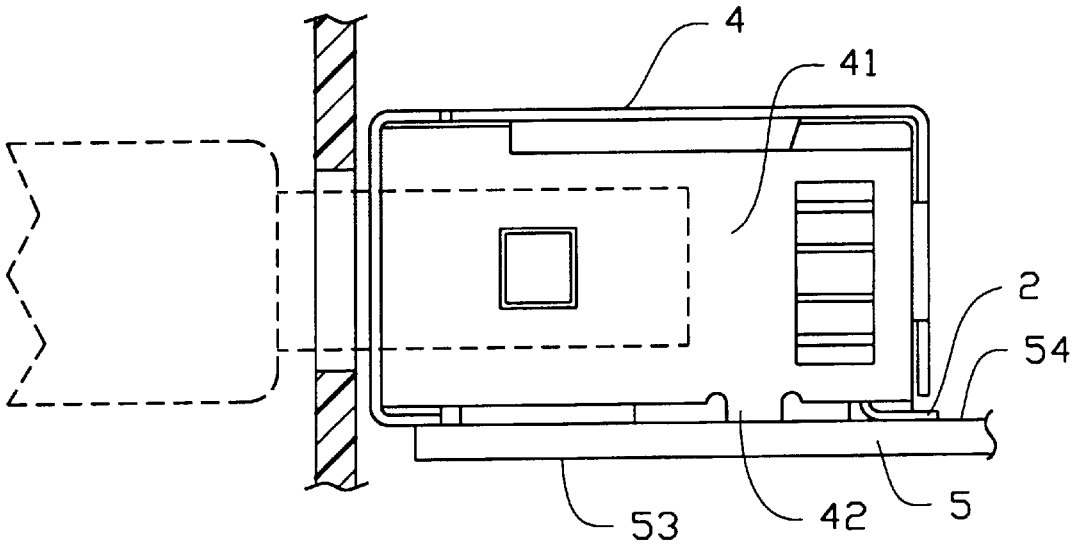
FIG. 4 is a side elevation view of the electrical connector with the retention mechanism assembled to a mating circuit board.
Figure 6A:
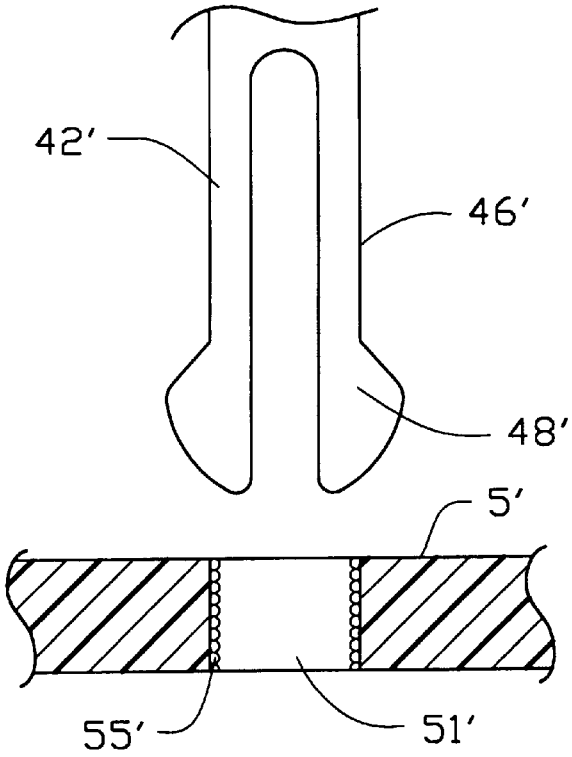
FIG. 6A (PRIOR ART)
FIG. 6A & 6B are cross sectional views showing a conventional retention mechanism before and after assembly, respectively.
Figure 6B:
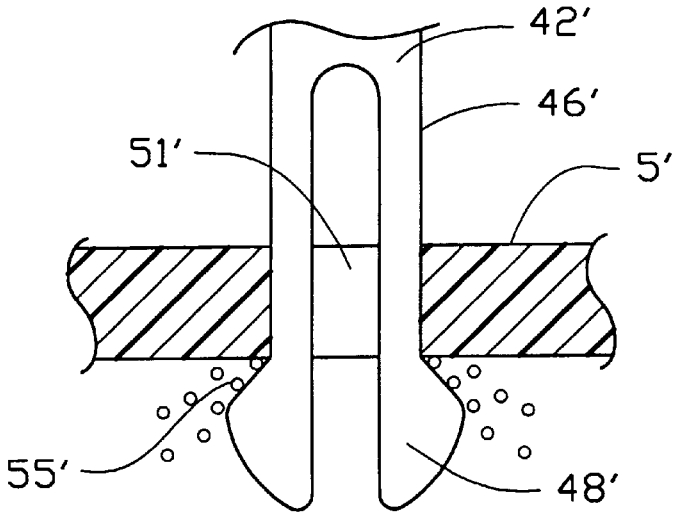
FIG. 6B (PRIOR ART)

Referring to FIGS. 1 and 4, before the electrical connector is fixed to the circuit board 5, solder 55 is applied to a mating surface 54 of the circuit board 5. Solder 55 is also coated on the inner surfaces 52 of the positioning holes 51. When the electrical connector is fixed to the circuit board 5, the retention mechanism will engage within the corresponding positioning hole 51 of the circuit board 5. The engaging means 43 of the lugs 42 interferentially engage with the inner surfaces 52 of the positioning holes 51, while end edges 44 of the lugs 42 do not extend beyond the bottom surface 53 of the circuit board 5. Thus, the solder 55 coated on the inner surfaces of the positioning holes 51 will not be scraped off.

Figure 5:
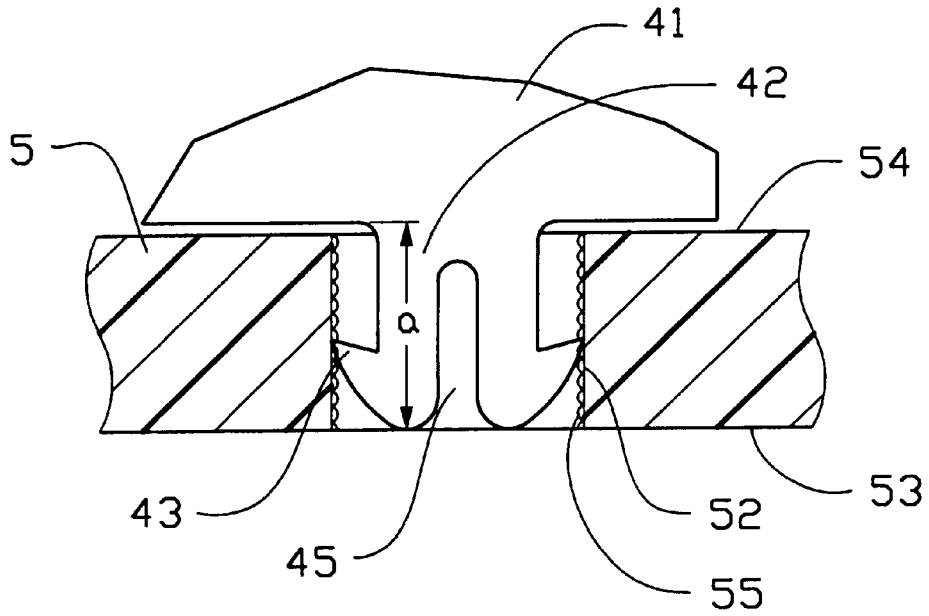
FIG. 5 is a cross sectional view of a retention mechanism in accordance with a second embodiment of the present invention received in a through hole of a circuit board.

Referring to FIG. 5, the retention mechanism of a second embodiment also comprises a pair of lugs 42 similar to the first embodiment. The difference between the first and second embodiments is that a cutout 45 is further defined between the pair of barbs of the engaging means 43 thereby providing the lugs 42 with resilience while achieving the same effects as described in the first embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combination of a circuit board defining a hole therein and having a thickness, and an electrical connector secured to the board, the connector comprising:

a dielectric housing;

a plurality of contacts received in the housing;

a shield enclosing the dielectric housing; and a retention mechanism integrally formed on the shield and comprising at least one lug retained to and substantially lying within the hole defined in the board, said lug having a length no greater than the thickness of the board, and comprising engaging means with an arcuate configuration at a bottom portion thereof for easy insertion into the hole and with only a pair of barbs extending outwardly and upwardly at two opposite sides thereof for efficiently interferentially engaging with an interior surface of the hole.

* * * * *